US008816922B2

(12) United States Patent
Aoki et al.

(10) Patent No.: US 8,816,922 B2
(45) Date of Patent: Aug. 26, 2014

(54) MULTI-FREQUENCY ANTENNA

(75) Inventors: Yutaka Aoki, Ome (JP); Akira Saitou, Machida (JP); Kazuhiko Honjo, Tsukuba (JP)

(73) Assignee: Casio Computer Co., Ltd., Tokyo (JP)

( * ) Notice: Subject to any disclaimer, the term of this patent is extended or adjusted under 35 U.S.C. 154(b) by 332 days.

(21) Appl. No.: 13/127,274

(22) PCT Filed: Mar. 4, 2010

(86) PCT No.: PCT/JP2010/053563

§ 371 (c)(1), (2), (4) Date: May 3, 2011

(87) PCT Pub. No.: WO2011/013395

PCT Pub. Date: Feb. 3, 2011

(65) Prior Publication Data

US 2011/0210899 A1 Sep. 1, 2011

(30) Foreign Application Priority Data

Jul. 31, 2009 (JP) ..... 2009-180009

(51) Int. Cl.

| | |
|---|---|
| ***H01Q 9/00*** | (2006.01) |
| ***H01Q 9/40*** | (2006.01) |
| ***H01Q 9/04*** | (2006.01) |
| ***H01Q 5/00*** | (2006.01) |
| ***H01Q 9/32*** | (2006.01) |

(52) U.S. Cl.

CPC ..... *H01Q 5/0062* (2013.01); *H01Q 9/40* (2013.01); *H01Q 9/0457* (2013.01); *H01Q 5/0041* (2013.01); *H01Q 9/32* (2013.01); *H01Q 5/0037* (2013.01)

USPC ..... 343/749; 343/745

(58) Field of Classification Search

USPC ..... 343/749, 745, 750

See application file for complete search history.

(56) References Cited

U.S. PATENT DOCUMENTS 3,909,830 A 9/1975 Campbell

FOREIGN PATENT DOCUMENTS

JP 08-213820A 8/1996
JP 2002-076750A 3/2002

(Continued)

OTHER PUBLICATIONS

Japanese Office Action dated Aug. 28, 2012 (and English translation thereof) in counterpart Japanese Application No. 2009-180009.
International Search Report dated Jun. 1, 2010 issued in International Appln. No. PCT/JP2010/053563-.

*Primary Examiner* — Ahshik Kim
(74) *Attorney, Agent, or Firm* — Holtz Holtz Goodman & Chick PC

(57) ABSTRACT

A multi-frequency antenna (1) comprises a dielectric substrate (100), an antenna element (110), a shunt inductor (120), a capacitor conductor (130), a series inductor (140), a grounded part (150) and a feeding point (160). The antenna element (110) is arranged on the substrate (100), and is electrically connected to the grounded part (150) through the shunt inductor (120). Moreover, the antenna element (110) is electrically connected to the feeding point (160) through a series capacitor formed by a part where the antenna element (110) faces the capacitor conductor (130) and the substrate (100) therebetween, and through the series inductor (140).

20 Claims, 18 Drawing Sheets

(56) References Cited

U.S. PATENT DOCUMENTS

| | | | | |
|---|---|---|---|---|
| 4,145,693 | A | 3/1979 | Fenwick | |
| 2002/0044092 | A1 | 4/2002 | Kushihi | |
| 2002/0105474 | A1 | 8/2002 | Kitamura et al. | |
| 2003/0231142 | A1* | 12/2003 | McKinzie et al. | 343/909 |
| 2006/0262028 | A1 | 11/2006 | Takei | |
| 2009/0278755 | A1* | 11/2009 | Shoji | 343/745 |

FOREIGN PATENT DOCUMENTS

| | | | |
|---|---|---|---|
| JP | 2002-232313 | A | 8/2002 |
| JP | 2007-068037 | A | 3/2007 |
| WO | WO2004/036687 | A1 | 4/2004 |

* cited by examiner

MULTI-FREQUENCY ANTENNA

This application is a U.S. National Phase Application under 35 USC 371 of International Application PCT/JP2010/053563 filed Mar. 4, 2010.

TECHNICAL FIELD

The present invention relates to an antenna with a function of transmitting/receiving wireless signals with multiple frequencies.

BACKGROUND ART

Various kinds of wireless communication systems, such as a wireless LAN and Bluetooth (registered trademark), are widely used.

Those wireless communication systems each have an advantage and a disadvantage.

Hence, it is popular to use plural wireless communication systems in combination, not to use one wireless communication system alone.

However, there is a difference in the frequency bands used by the individual wireless communication systems.

Accordingly, in order to use plural wireless systems, it is necessary to transmit/receive wireless signals in respective multiple frequency bands. In order to transmit/receive wireless signals with multiple frequencies, it is necessary either to use plural antennas each for a single frequency or to use a multi-frequency antenna coping with multiple frequencies. However, it is advantageous in terms of miniaturization, simplification and cost reduction of an antenna to use the multi-frequency antenna than to use the plural antennas each for a single frequency.

An illustrative multi-frequency antenna is disclosed in patent literature 1. This multi-frequency antenna comprises a conductor plate, a dielectric body provided on the conductor plate, and plural antenna elements contacting the dielectric body and having different characteristics from one another. The plural antenna elements operate at different frequency bands from one another. Consequently, a single antenna can operate at multiple frequency bands.

PRIOR ART DOCUMENT

Patent Literature

Patent Literature 1: Unexamined Japanese Patent Application KOKAI Publication No. 2007-068037

DISCLOSURE OF INVENTION

Problem to be Solved by the Invention

The multi-frequency antenna disclosed in patent literature 1 comprises the plural antenna elements. Accordingly, a large space for installing the plural antenna elements is required, and thus the size of the multi-frequency antenna becomes large. Moreover, the configuration of the multi-frequency antenna becomes complex.

The present invention has been made in view of the foregoing problem, and it is an object of the present invention to provide a small multi-frequency antenna with a non-complex configuration.

Moreover, it is another object of the present invention to provide a multi-frequency antenna which can be used at multiple frequency bands with a single antenna element.

Means for Solving the Problem

To achieve the foregoing objects, a multi-frequency antenna according to the present invention comprises an antenna element; a first inductor that connects the antenna element and a grounded part together; a feeding point; and a series circuit including a second inductor and a capacitor which connects the feeding point and the antenna element together.

For example, inductances of the first inductor and the second inductor and a capacitance of the capacitor each has a value generating a plurality of resonance frequencies.

For example, the antenna element is rectangular or has a configuration with a width at an open-end side wider than a width at a feeding-point side.

For example, the multi-frequency antenna further comprises a dielectric plate, wherein the antenna element is formed on one face of the dielectric plate, the first inductor is arranged on another face of the dielectric plate and is connected to the antenna element through a via, the capacitor comprises a part of the antenna element, a conductive body which is arranged on the another face of the dielectric plate and which faces the part of the antenna element and a dielectric plate arranged between the part of the antenna element and the conductive body, and the second inductor is arranged on the one face of the dielectric plate and is connected between the capacitor and the feeding point.

For example, the second inductor is connected to the conductive body through a via or by capacitive coupling.

For example, at least one of the first inductor, the second inductor and the capacitor comprises a circuit component.

For example, at least one of the first inductor and the second inductor comprises a line.

For example, the multi-frequency antenna further comprises adjusting means which adjusts at least one element constant of the first inductor, the second inductor and the capacitor.

Effect of the Invention

According to the present invention, it is possible to provide a small multi-frequency antenna with a non-complex configuration. Moreover, according to the present invention, it is possible to provide a multi-frequency antenna which can be utilized at multiple frequency bands by using a single antenna element.

BEST MODE FOR CARRYING OUT THE INVENTION

First Embodiment

An explanation will be given of a multi-frequency antenna 1 according to a first embodiment of the present invention.

First, an explanation will be given of a configuration of the multi-frequency antenna 1 of the first embodiment with reference to FIGS. 1 to 4.

Figure 1:
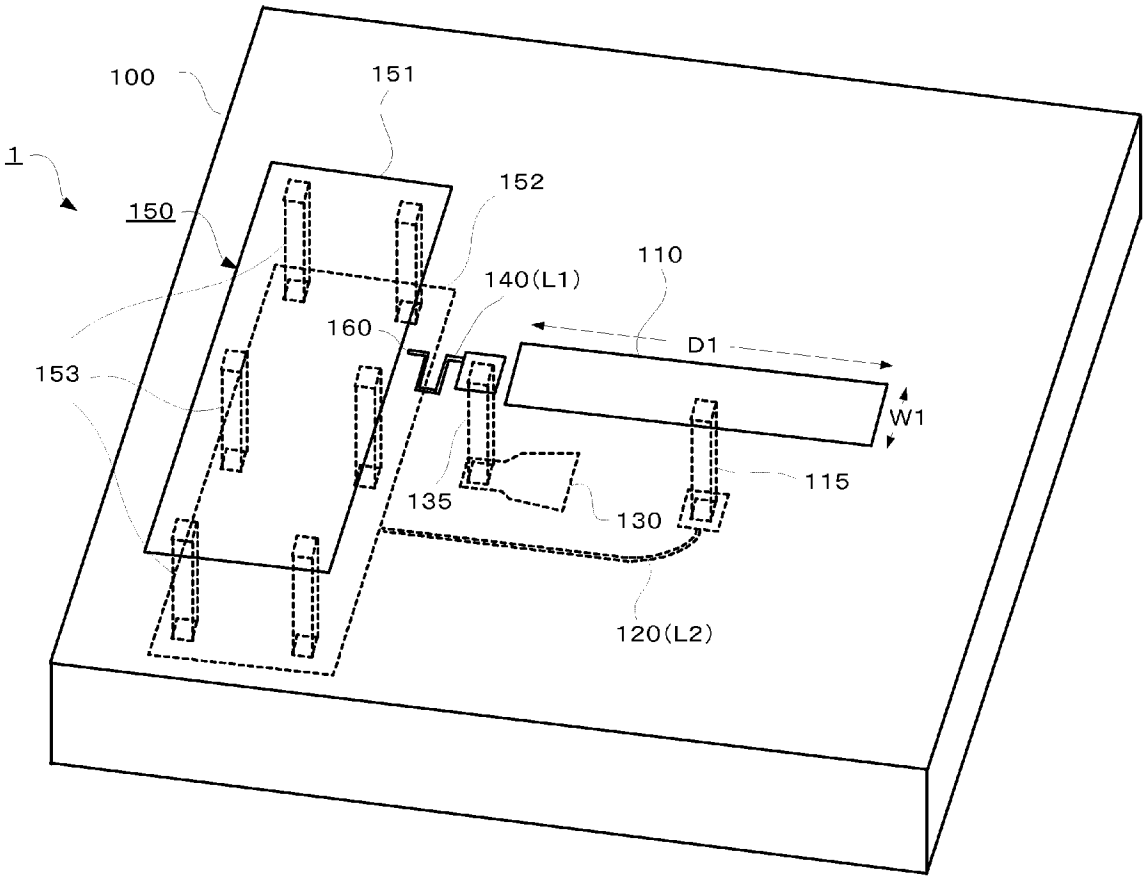
FIG. 1 is a perspective view showing a multi-frequency antenna according to a first embodiment of the present invention.
Figure 2:
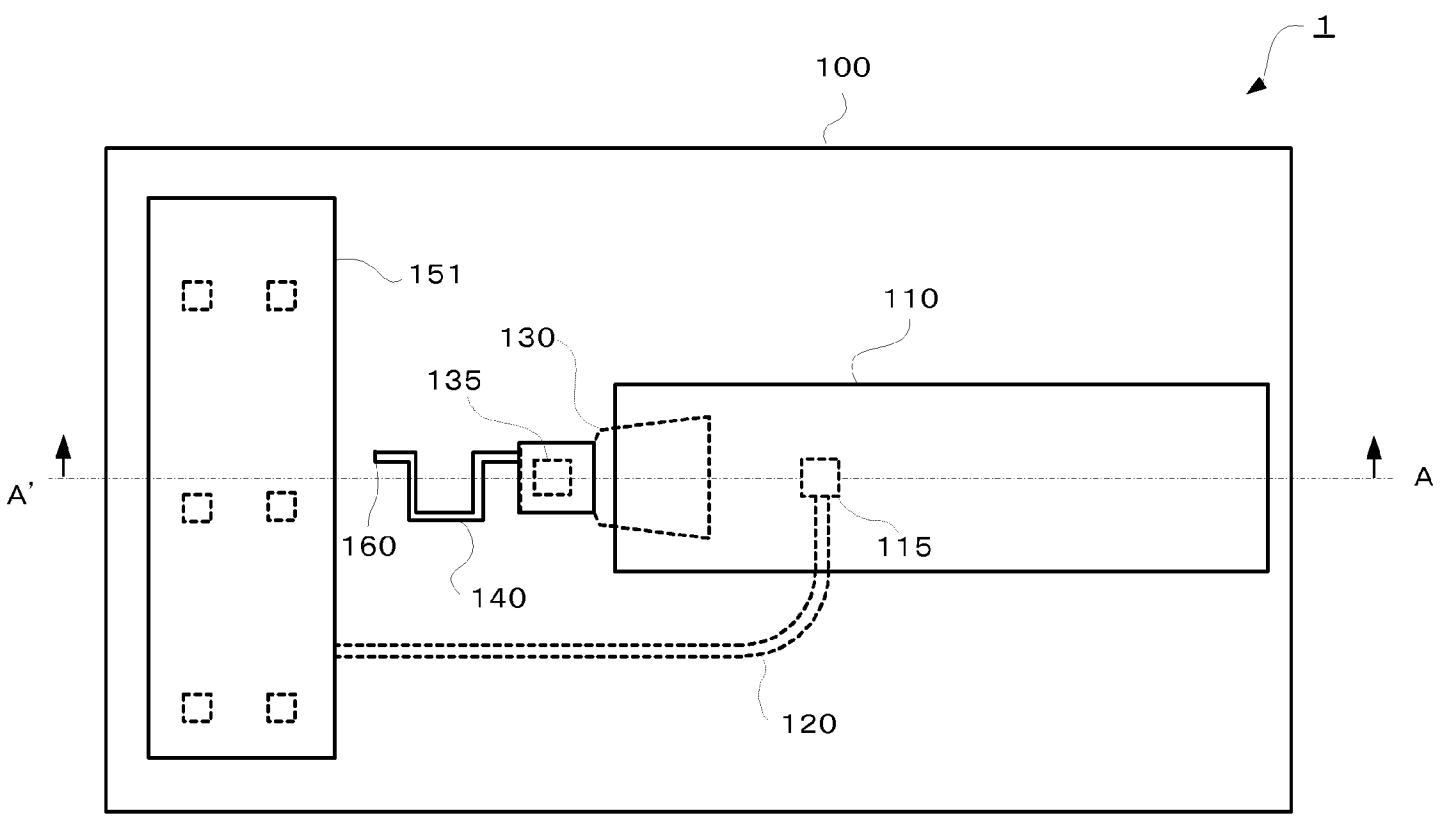
FIG. 2 is a plan view showing the multi-frequency antenna shown in FIG. 1.
Figure 3:
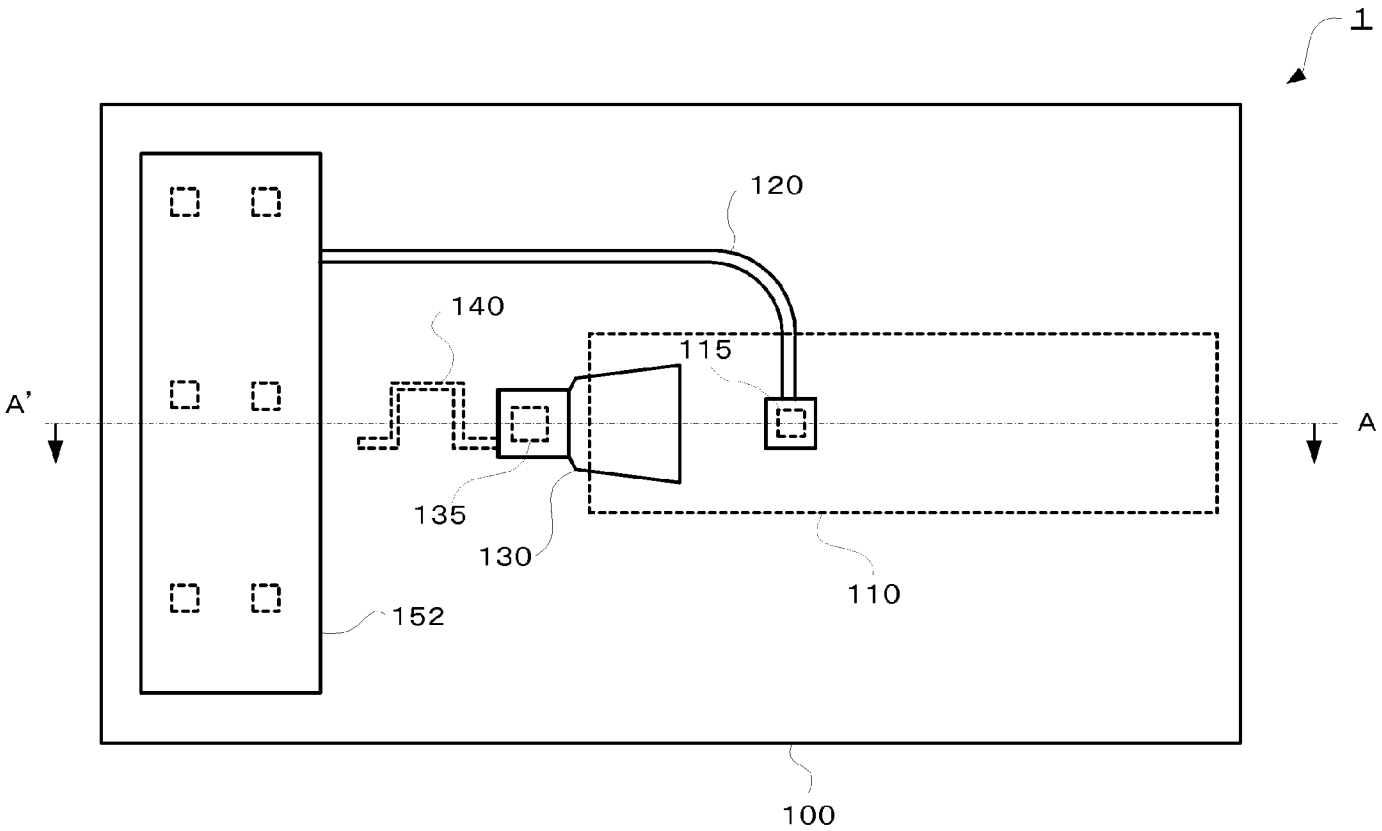
FIG. 3 is a bottom view showing the multi-frequency antenna shown in FIG. 1.
Figure 4:
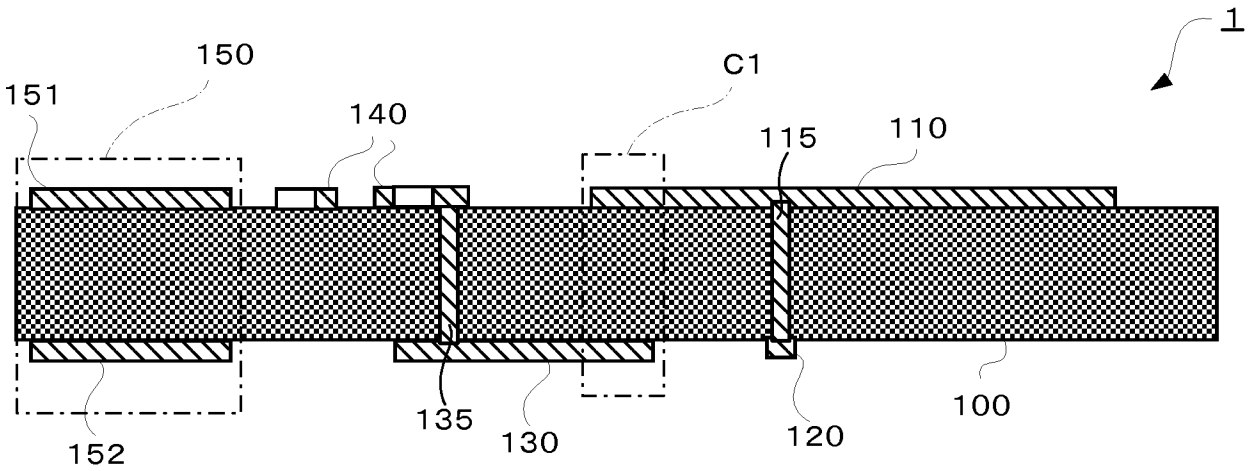
FIG. 4 is a cross-sectional view showing the multi-frequency antenna shown in FIG. 1.

FIG. 1 is a perspective view showing the multi-frequency antenna 1, FIG. 2 is a plan view showing the multi-frequency antenna 1, FIG. 3 is a bottom view showing the multi-frequency antenna 1, and FIG. 4 is a cross-sectional view showing a cross section of the multi-frequency antenna 1 along a line A-A' in FIG. 2 and FIG. 3.

As shown in the diagrams, the multi-frequency antenna 1 comprises a substrate 100, an antenna element 110, a via 115, a shunt inductor 120, a capacitor conductor 130, a via 135, a series inductor 140, a grounded part 150 and a feeding point 160.

The substrate 100 comprises a tabular dielectric material. In the present embodiment, the substrate 100 comprises a tabular glass-epoxy substrate (FR4) with a relative permittivity of 4.6, and with a size of 12 mm by 12 mm and a thickness of 1 mm.

The antenna element 110 comprises a rectangular conductor plate, and is arranged on one-side surface of the substrate 100. In the present embodiment, the antenna element 110 is formed of a rectangular copper foil with a width W1 of 3.0 mm and a depth D1 of 8.0 mm.

The via 115 is so formed at a substantial center of the antenna element 110 as to pass all the way through from the one-side surface of the substrate 100 to another-side surface thereof, and is filled with a conducting body having one end connected to the antenna element 110.

The shunt inductor 120 comprises a line conducting body, runs on another-side surface of the substrate 100, and has one end connected to another end of the via 115. In the present embodiment, the inductance of the shunt inductor 120 is set to be 5.1 nH.

The capacitor conductor 130 is so arranged on another-side surface of the substrate 100 as to face a part of the antenna element 110. A series capacitor C1 connected to the antenna element 110 in series is formed by a part where the antenna element 110 and the capacitor conductor 130 face each other, and a part of the substrate 100 located between those parts. In the present embodiment, the capacitance of the series capacitor C1 is 0.16 pF.

The via 135 is formed so as to pass all the way through from the one-side surface of the substrate 100 to another-side surface thereof. The via 135 is filled with a conducting body which has one end connected to one end of the capacitor conductor 130.

The series inductor 140 is formed on the one-side surface of the substrate 100, has one end connected to another end of the via 135 and has another end functioning as the feeding point 160. In the present embodiment, the inductance of the series inductor 140 is 5.7 nH.

The grounded part 150 has a ground conductor 151 arranged on one-side surface at a side of the substrate 100, a ground conductor 152 arranged on another-side surface at a side of the substrate 100 and plural vias 153 for connecting the ground conductor 151 and the ground conductor 152 together, and is grounded.

The feeding point 160 comprises another end of the series inductor 140, and is connected to a non-illustrated feeder wire. The multi-frequency antenna 1 emits a transmitting signal supplied between the grounded part 150 and the feeding point 160 to a space as a radio wave, converts a received radio wave into an electric signal and transmits the electric signal from the feeding point 160 to the feeder wire.

The multi-frequency antenna 1 employing the above-explained configuration is formed through, for example, the following steps a) to d).

a) Open the vias 115, 135, and 153 in the substrate 100.

b) Fill openings of those vias by plating or the like.

c) Paste copper foils to both surfaces of the substrate 100.

d) Form the antenna element 110, the shunt inductor 120, the capacitor conductor 130, the series inductor 140 and the ground conductor 151 by patterning the copper foils through PEP (photo etching process) or the like.

Figure 5:
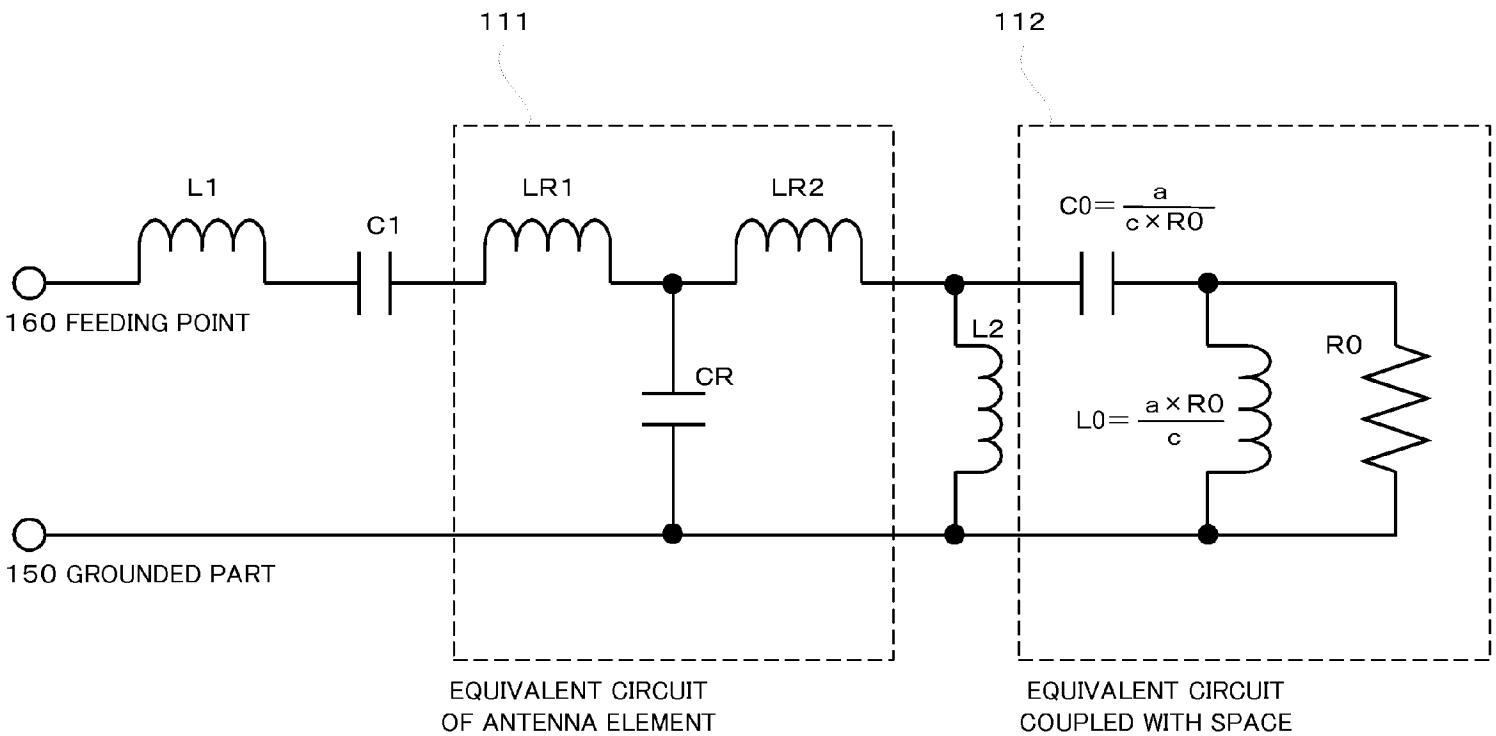
FIG. 5 is an equivalent circuit diagram of the multi-frequency antenna shown in FIG. 1.

An electrical configuration of the multi-frequency antenna 1 employing the above-explained physical configuration can be expressed by an equivalent circuit shown in FIG. 5.

As is illustrated, the multi-frequency antenna 1 electrically comprises a series inductor L1, the series capacitor C1, an equivalent circuit 111 for the antenna element, a shunt inductor L2, an equivalent circuit 112 expressing coupling with a space, the feeding point 160, and the grounded part 150.

Note that the series inductor L1 comprises the series inductor 140 and the shunt inductor L2 comprises the shunt inductor 120. Moreover, the series capacitor C1 comprises the series capacitor C1 formed by a part where the antenna element 110 and the capacitor conductor 130 face each other, and the substrate 100 between those parts.

The equivalent circuit 111 of the antenna element represents an input impedance of the antenna element 110 as a right-handed line, and includes an inductor LR1, an inductor LR2 and a capacitor CR.

The equivalent circuit 112 coupled with a space depends on the size of the antenna element 110 and on the shape thereof, and represents an impedance by coupling of the antenna element 110 with a space. The equivalent circuit 112 includes a capacitor C0, a reference impedance R0 and an inductor L0, and is connected to a inductance L2 in parallel therewith.

As shown in FIG. 5, the feeding point 160 is connected to one end of a series circuit including the series inductor L1 and the series capacitor C1.

Another end of the series circuit including the series inductor L1 and the series capacitor C1 is connected to one end of the inductor LR1 configuring the equivalent circuit 111 of the antenna element. Another end of the inductor LR1 is connected to one end of the capacitor CR and to one end of the inductor LR2. Another end of the capacitor CR is connected to the grounded part 150.

One end of the shunt inductor L2 is connected to another end of the inductor LR2 of the equivalent circuit 111 of the antenna element. Another end of the shunt inductor L2 is connected to the grounded part 150.

One end of the capacitor C0 of the equivalent circuit 112 coupled with a space is connected to a connection point between another end of the inductor LR2 and the one end of the shunt inductor L2. Another end of the capacitor C0 is connected to one end of the inductor L0 and to one end of the reference impedance R0. Another end of the inductor L0 and another end of the reference impedance R0 are both connected to the grounded part 150.

Figure 6:
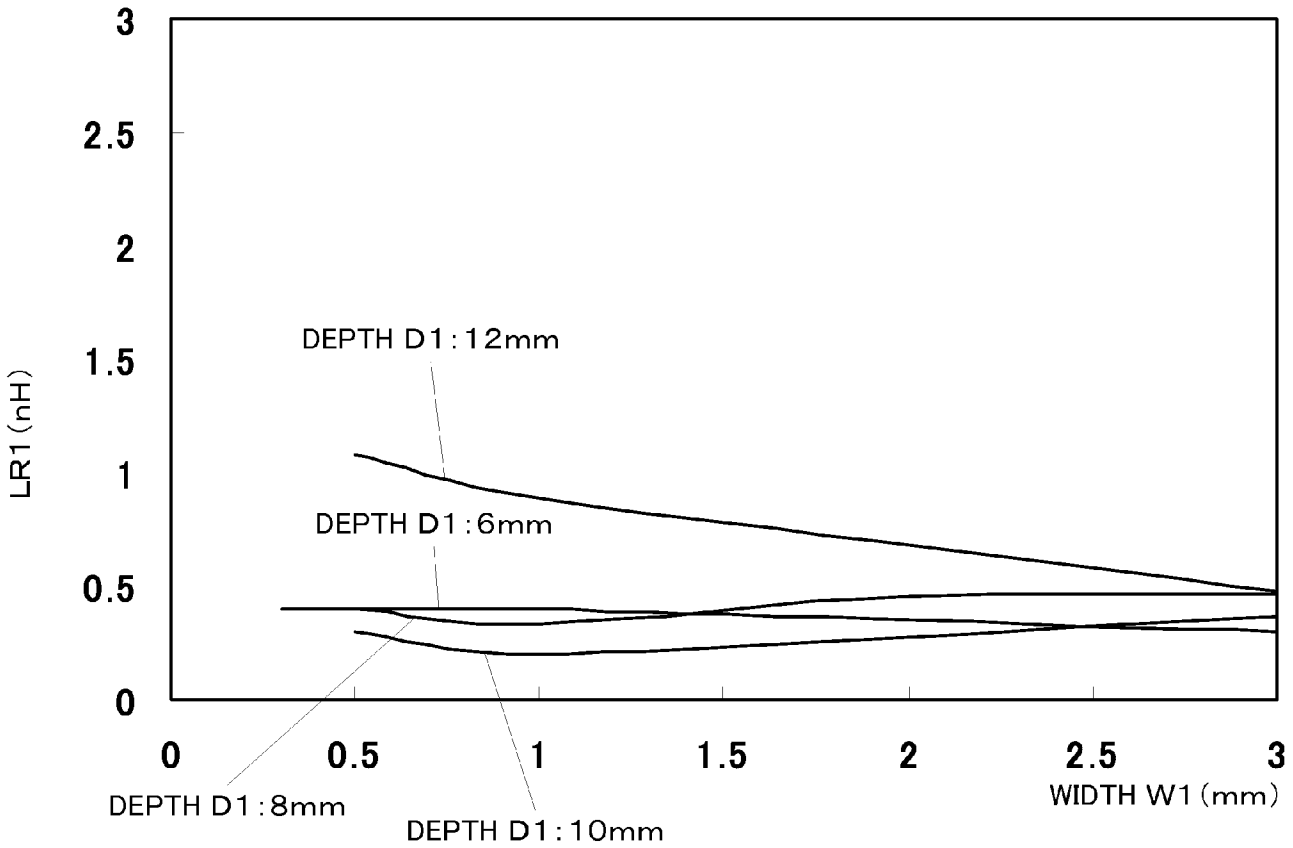
FIG. 6 is a diagram showing a relationship between the dimension of the antenna element in FIG. 1 and the inductance of the antenna element.
Figure 7:
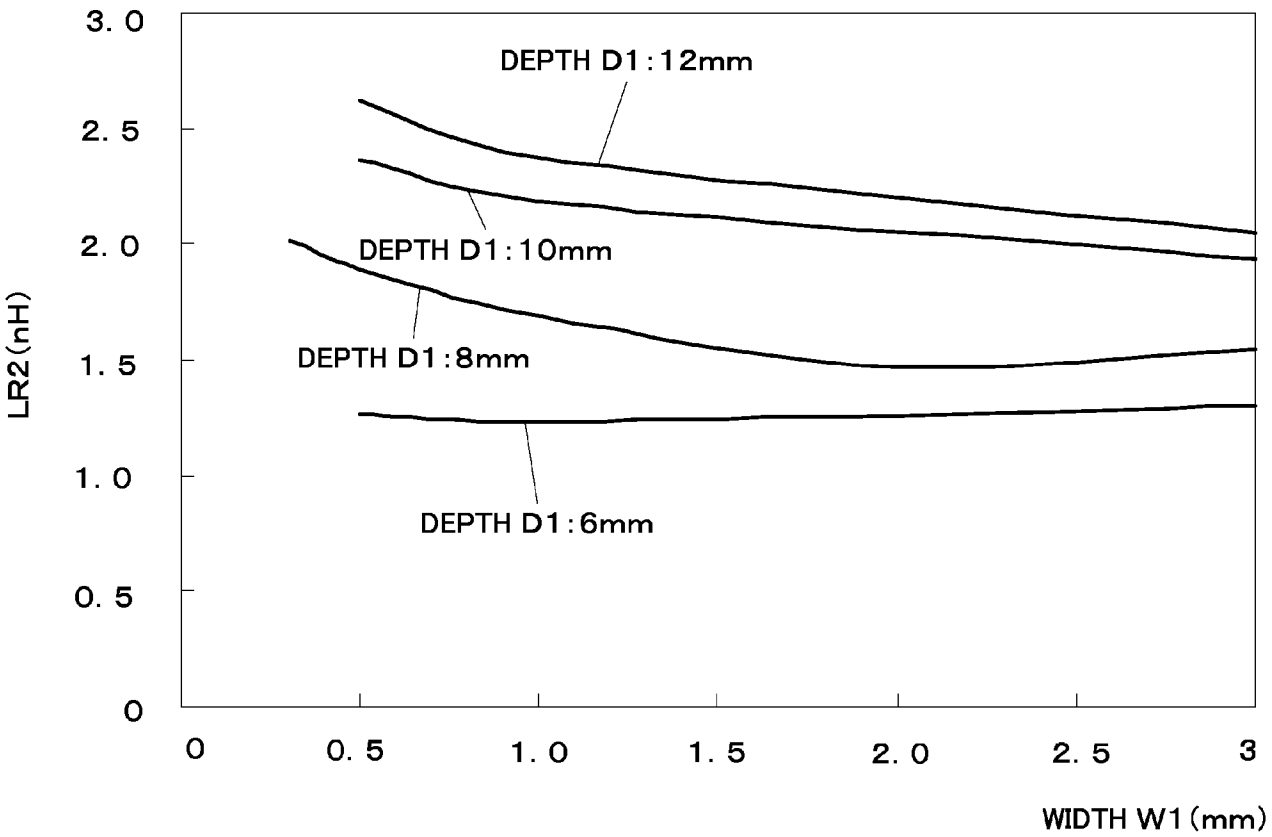
FIG. 7 is a diagram showing a relationship between the dimension of the antenna element in FIG. 1 and the inductance of the antenna element.
Figure 8:
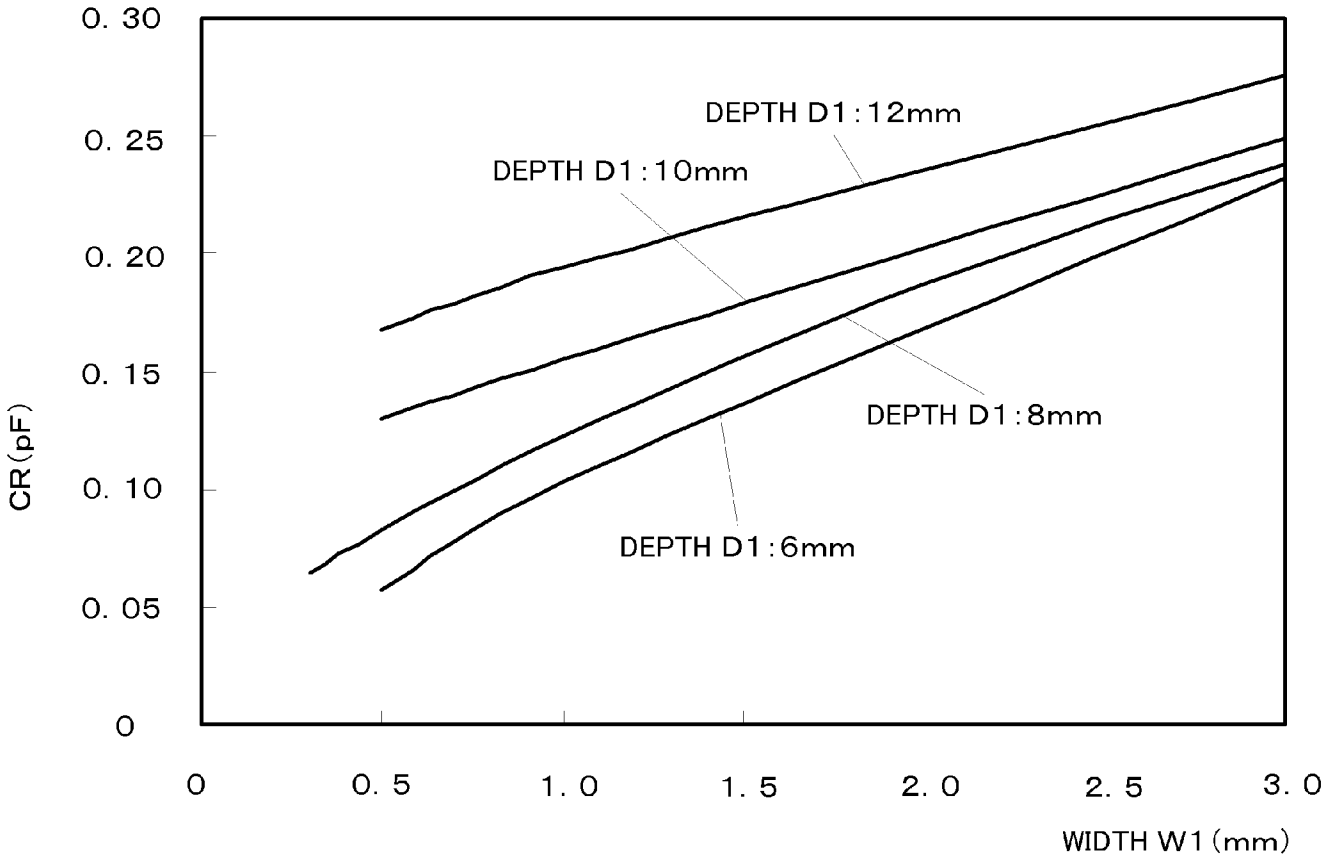
FIG. 8 is a diagram showing a relationship between the dimension of the antenna element in FIG. 1 and the capacitance of the antenna element.

The inductance of the inductor LR1, the inductance of the inductor LR2 and the capacitance of the capacitor CR all in the equivalent circuit 111 of the antenna element substantially depend on the size of the antenna element 110 and on the shape thereof, and are substantially determined once the shape of the antenna element 110 and the size thereof are determined. Examples of the size (D1, W1) of the antenna element 110, the inductances of the respective inductors LR1, LR2, and the capacitance of the capacitor CR are shown in FIG. 6 to FIG. 8.

Moreover, the value of the reference impedance R0 in the equivalent circuit 112 coupled with a space depends on the size of the antenna element 110 and on the shape thereof. The value of the reference impedance R0 corresponds to the actual component of an impedance representing, when a voltage with a target frequency is applied to the feeding point 160, a ratio between the applied voltage and a flowing current.

Note that in the present embodiment, target frequencies are set to be 2.5 GHz and 5.5 GHz.

Figure 9:
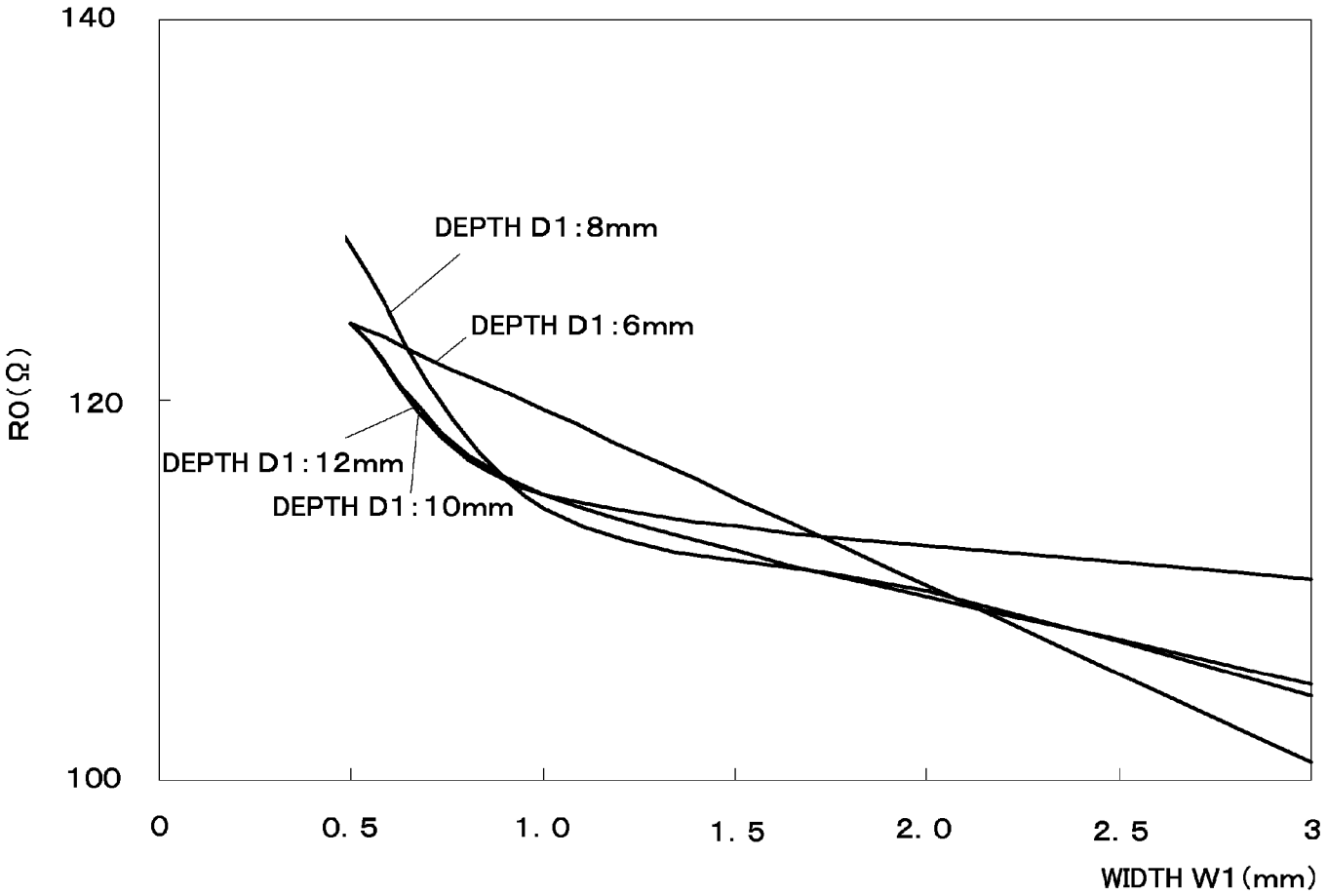
FIG. 9 is a diagram showing a relationship between the dimension of the antenna element and the reference impedance by coupling of the antenna element with a space.

A relationship between the size (D1, W1) of the antenna element 110 and the reference impedance R0 is shown in FIG. 9.

Moreover, the capacitance of the capacitor C0 and the inductance of the inductor L0 both in the equivalent circuit 112 coupled with a space depend on a radius a of a sphere involving the antenna element 110 and on the reference impedance R0, and can be expressed by formulas (1) and (2), respectively.

$$C0=a/(c\times R0) \quad (1)$$

$$L0=(a\times R0)/c \quad (2)$$

where

C0: the capacitance [F] of the capacitor C0

L0: the inductance [H] of the inductor L0

R0: the resistance [Ω] value of the reference impedance R0 a: the radius [m] of the sphere involving the antenna element c: the speed of light [m/s]

As explained above, the equivalent circuit 111 of the antenna element and the equivalent circuit 112 coupled with a space both depend on the shape of the antenna element 110 and on the size thereof. Consequently, the equivalent circuit 111 of the antenna element and the equivalent circuit 112 coupled with a space are substantially determined by setting the shape of the antenna element 110 and the size thereof.

Next, an explanation will be given of a frequency characteristic of reflection loss by the multi-frequency antenna 1 employing the above-explained physical configuration and electrical configuration.

Figure 10:
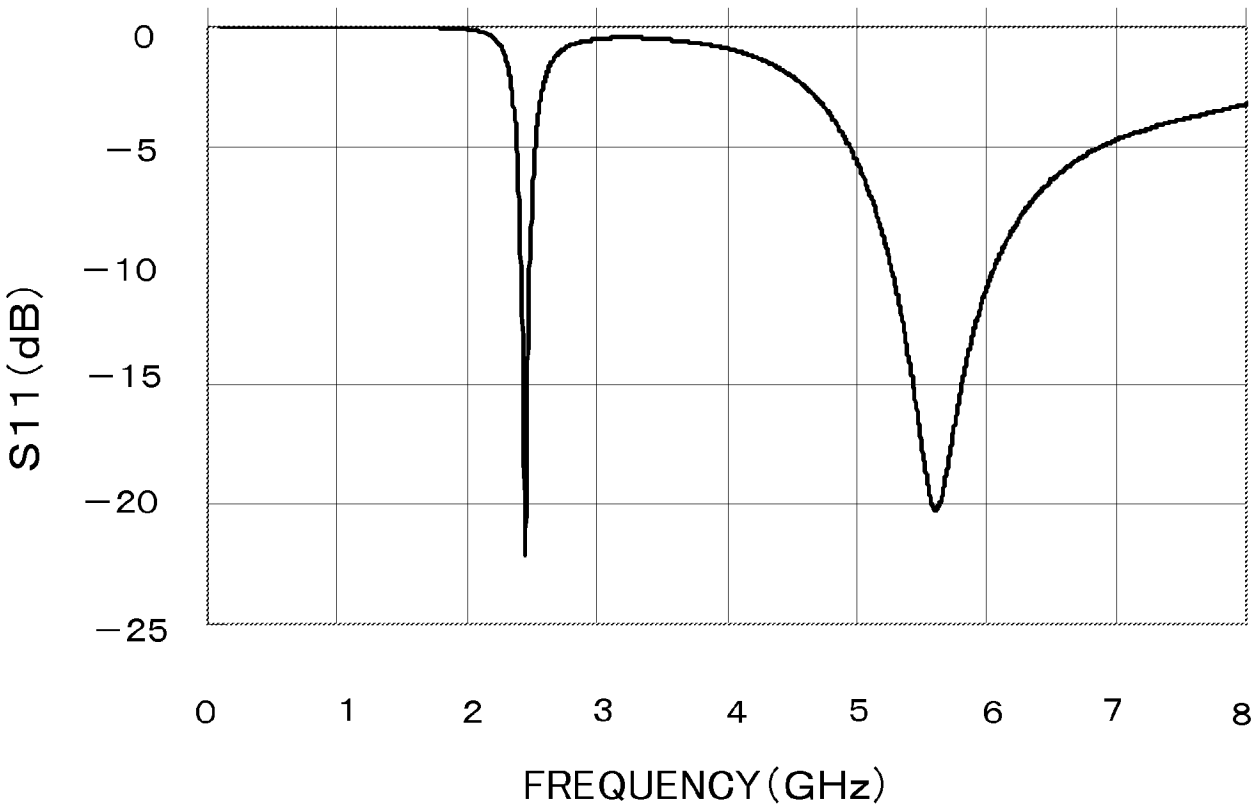
FIG. 10 is a graph showing a frequency characteristic of reflection loss by the multi-frequency antenna shown in FIG. 1 to FIG. 5.

The frequency characteristic of reflection loss by the multi-frequency antenna 1 is shown in FIG. 10. This characteristic is the frequency characteristic of reflection loss with the width W1 of the antenna element 110 being set to 3.0 mm, the depth D1 thereof being set to 8.0 mm, the inductance of the shunt inductor L2 (120) being set to 5.1 nH, the capacitance of the series capacitor C1 being set to 0.16 pF, and the inductance of the series inductor L1 (140) being set to 5.7 nH.

Note that with the width W1 of the antenna element 110 being as 3.0 mm and the depth D1 thereof being as 8.0 mm, the inductance of each inductor and the capacitance of each capacitor in the equivalent circuit 111 of the antenna element and in the equivalent circuit 112 coupled with a space are acquired from above-explained FIG. 6 to FIG. 9 and through the above-explained formulas (1) and (2).

Moreover, the horizontal axis of FIG. 10 represents a frequency (GHz) and the vertical axis of FIG. 10 represents a reflection loss S11 (dB).

As shown in FIG. 10, according to this characteristic, S11 is equal to or less than −10 dB at two frequency bands: one in the vicinity of 2.5 GHz, and another in the vicinity of 5.5 GHz. S11 is below −10 dB in the vicinity of 2.5 GHz at a bandwidth of approximately 100 MHz, and is below −10 dB in the vicinity of 5.5 GHz at a bandwidth of approximately 800 MHz. Consequently, the multi-frequency antenna 1 can function as a multi-frequency antenna which can acquire a sufficient gain at the two frequencies: 2.5 GHz and 5.5 GHz.

As explained above, according to the first embodiment of the present invention, it is possible to provide a multi-frequency antenna which can carry out communication with respect to desired multiple frequencies by using the single antenna element 110.

In the above-explained illustrative configuration, the configuration enabling acquisition of a gain at the two frequency bands: 2.5 GHz and 5.5 GHz was exemplified. The present embodiment is not limited to this configuration. The present embodiment can cope with a combination of any two arbitrary frequency bands.

As explained above, element constants of the equivalent circuit 111 of the antenna element 110 and of the equivalent circuit 112 coupled with a space are automatically determined by the size of the antenna element 110. Accordingly, it is possible for the multi-frequency antenna to acquire sufficient gains at arbitrary multiple frequency bands by setting the inductance of the shunt inductor L2 (120), the capacitance of the series capacitor C1 and the inductance of the series inductor L1 (140) accordingly in such a way that a resonance point is generated in vicinities of multiple target frequencies in consideration of the individual element constants which are determined by the size of the antenna element 110.

Moreover, when the size of the antenna element 110 is changeable, it is appropriate if the individual element constants determined by the size of the antenna element 110, the inductance of the shunt inductor L2 (120), the capacitance of the series capacitor C1 and the inductance of the series inductor L1 (140) are set accordingly so that the resonance point is generated in the vicinities of the multiple target frequencies.

Second Embodiment

In the first embodiment, the shape of the antenna element 110 is rectangular. The rectangular antenna element 110 is easily manufactured, but has a difficulty in adjusting the impedance of the antenna element 110 as well as the impedance value by coupling with a space.

An explanation will be given of a multi-frequency antenna 2 according to a second embodiment which can overcome the foregoing problem.

Figure 11:
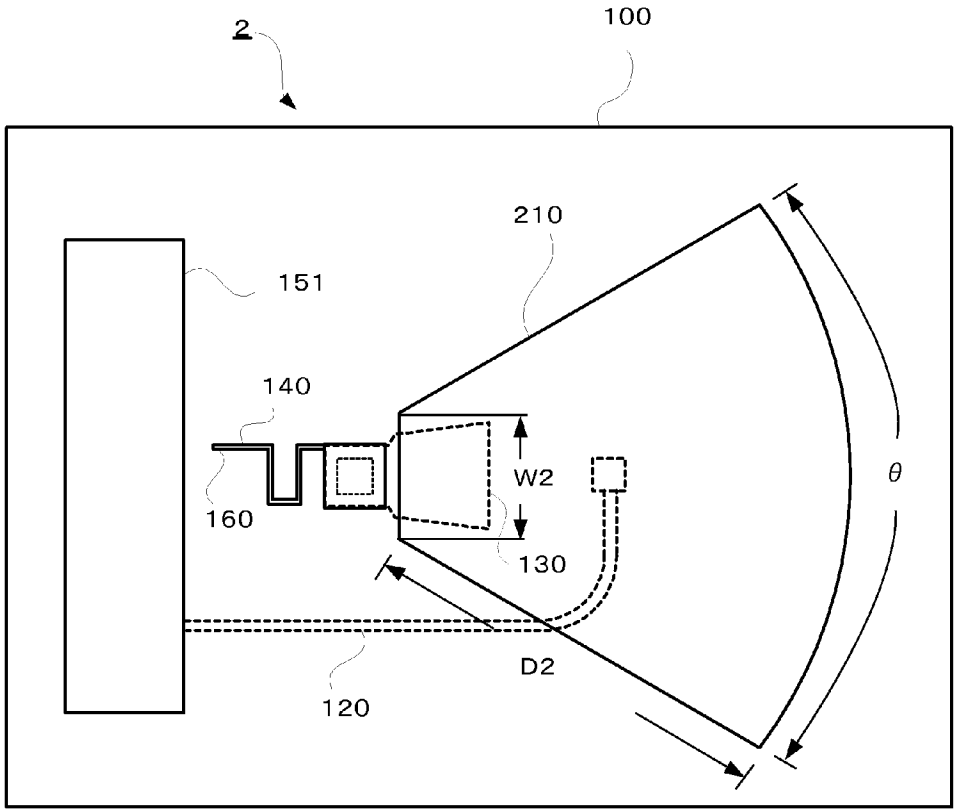
FIG. 11 is a plan view showing a multi-frequency antenna according to a second embodiment of the present invention.
Figure 12:
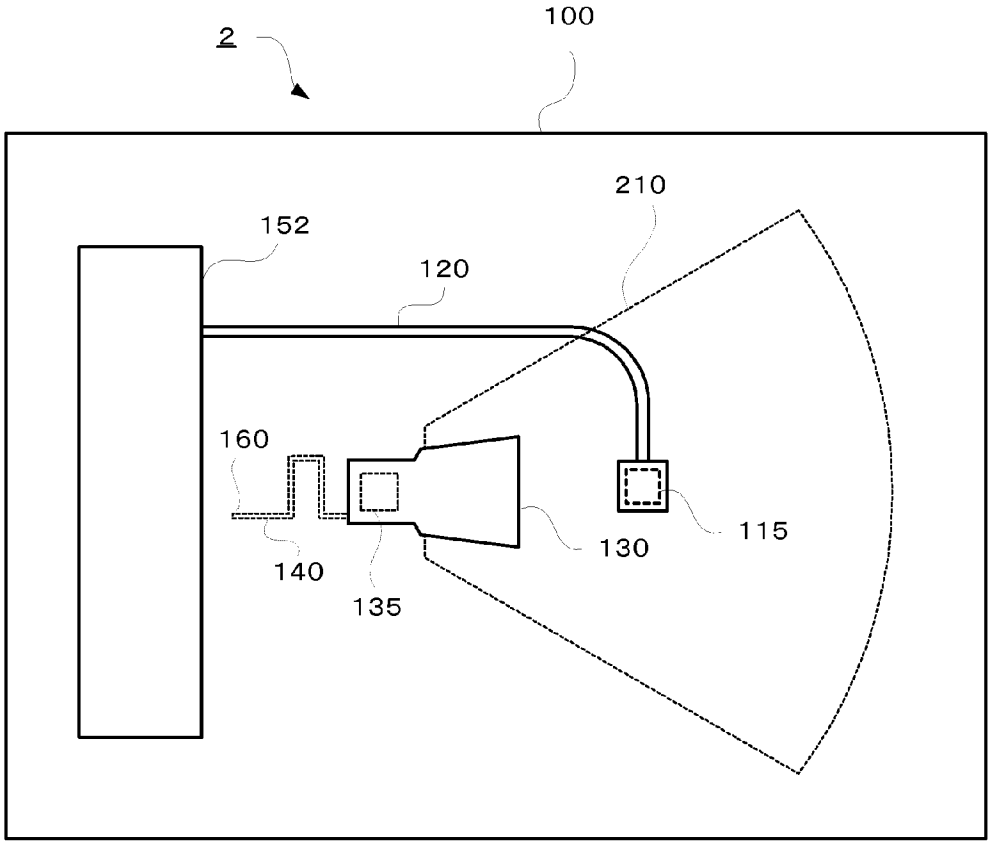
FIG. 12 is a bottom view showing the multi-frequency antenna according to the second embodiment of the present invention.

As shown in a plan view of FIG. 11 and in a bottom view of FIG. 12, the multi-frequency antenna 2 of the second embodiment has an antenna element 210 formed in a sectorial shape with a width at an open-end side being wider than a width at a feeding-point side. Other configurations are similar to those of the multi-frequency antenna 1 of the first embodiment.

An equivalent circuit of the multi-frequency antenna 2 is the same as the equivalent circuit shown in FIG. 5.

However, the inductance of a series inductor L1 (140) is set to be 3.70 nH, the capacitance of a series capacitor C1 is set to be 0.169 pF and the inductance of a shunt inductor L2 (120) is set to be 4.78 nH.

Figure 13:
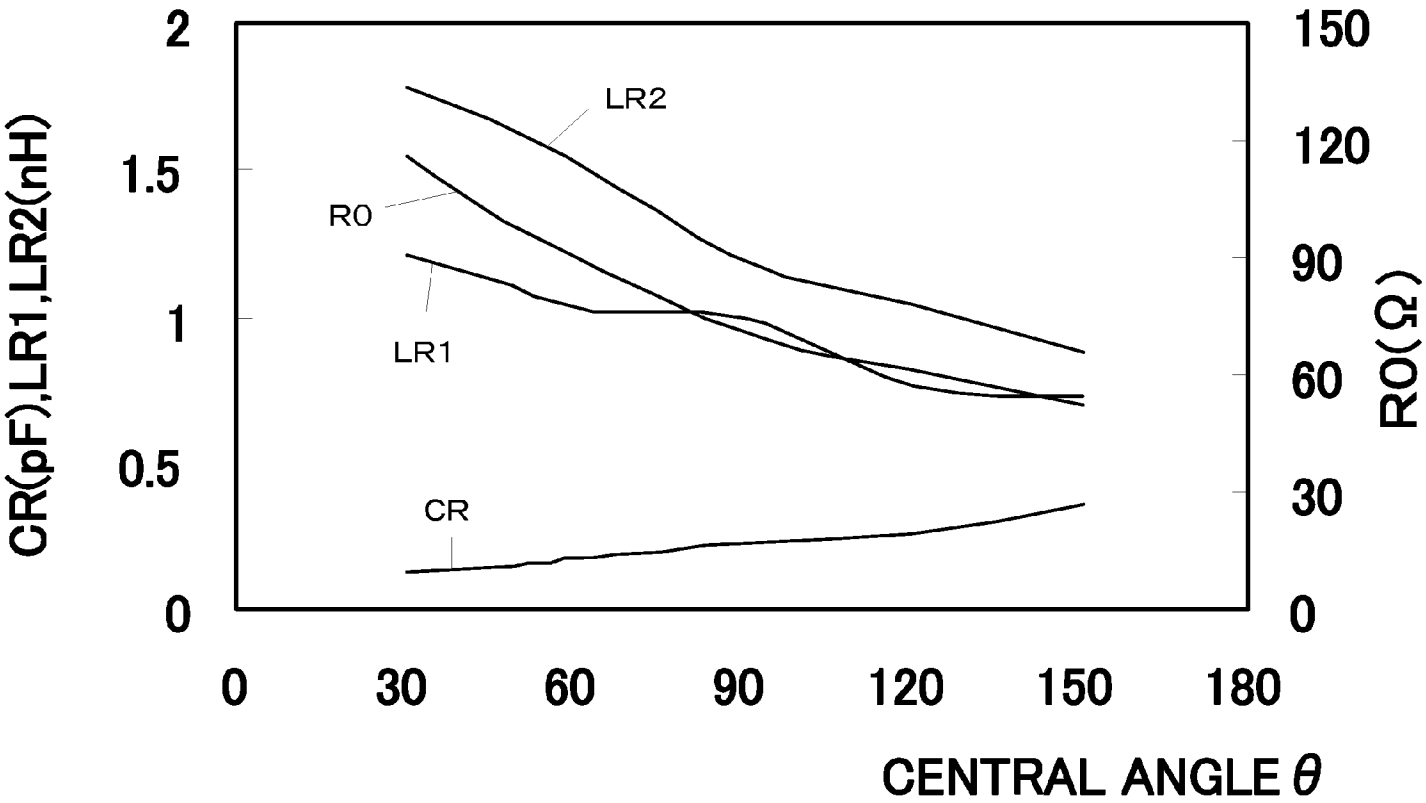
FIG. 13 is a graph showing a relationship among a central angle of a sectoral antenna element, an inductance and a capacitance of the antenna element, and a reference impedance by coupling of the antenna element with a space.

A relationship among a central angle θ of the sectorial antenna element 210, a reference impedance R0, respective inductances of inductors LR1, LR2 and the capacitance of a capacitor CR is shown in FIG. 13. The sectorial antenna element 210 has a length D2 set to be 8 mm and a width W2 set to be 2 mm at the feeding-point side.

As is clear from FIG. 13, the reference impedance R0 is equal to the reference impedance R0 of a rectangular antenna element 110 with the same size when the central angle θ is small, but becomes small as the central angle θ increases. Moreover, as the central angle θ becomes large, the respective inductances of the inductors LR1 and LR2 become small. Furthermore, the inductance of the inductor L0 in an equivalent circuit 112 coupled with a space is in proportion to the reference impedance R0, and conversely, the capacitance of the capacitor C0 is inversely proportional to the reference impedance R0.

In general, an inductor has a larger power loss than a capacitor. Accordingly, as the reference impedance R0 becomes small, the entire power loss of the equivalent circuit 112 coupled with a space is reduced. That is, the loss can be reduced by adjusting the central angle θ. Therefore, it is desirable that the central angle θ should be increased within a range permitted by the size of the multi-frequency antenna 2.

A frequency characteristic of reflection loss by the multi-frequency antenna 2 adjusted as explained above is shown in FIG. 14.

This characteristic is the frequency characteristic of reflection loss with the width W2 of the antenna element 210 at the feeding-point side being set to be 2.0 mm, the depth D2 being set to be 8.0 mm, the central angle θ being set to be 60 degree, the inductance of the series inductor L1 (140) being set to be 3.70 nH, the capacitance of the series capacitor C1 being set to be 0.169 pF, and the inductance of the shunt inductor L2 (120) being set to be 4.78 nH.

Figure 14:
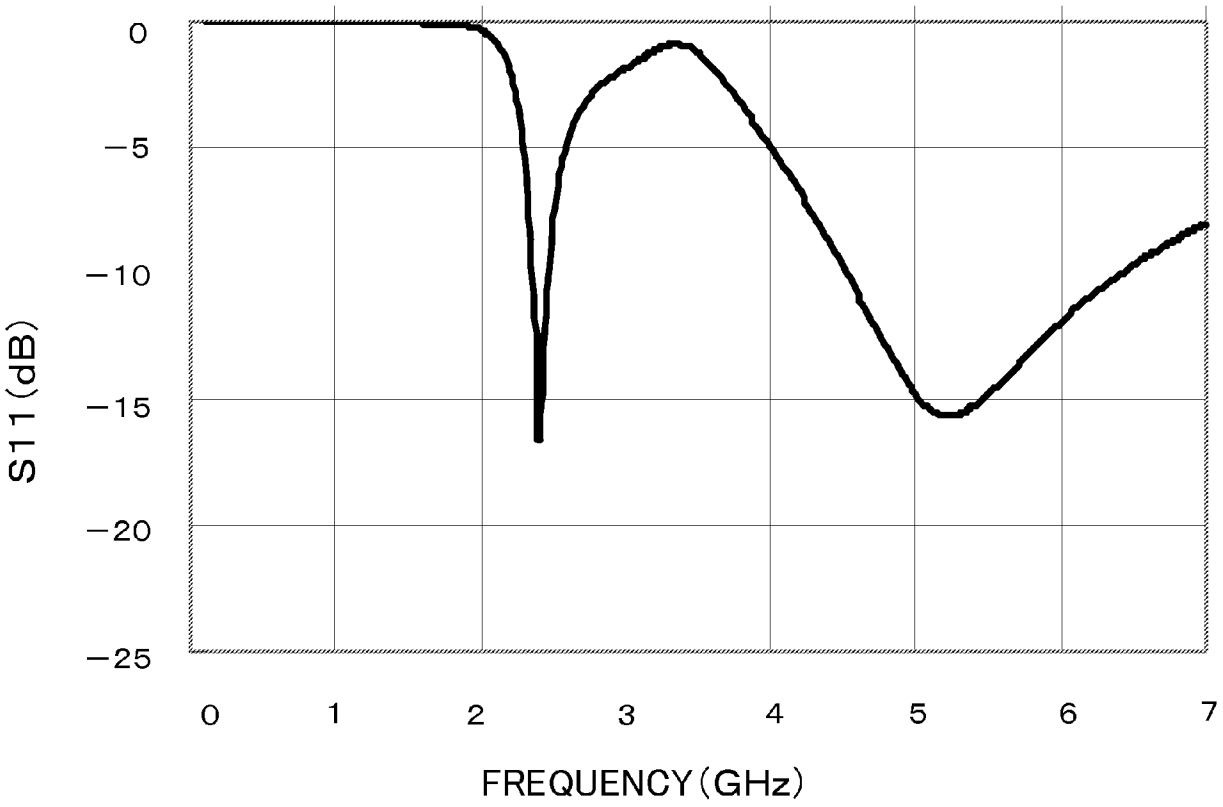
FIG. 14 is a graph showing a frequency characteristic of reflection loss by the multi-frequency antenna shown in FIG. 11 and FIG. 12.

The horizontal axis of FIG. 14 represents a frequency (GHz) and the vertical axis of FIG. 14 represents S11 (dB) indicating reflection loss.

According to the frequency characteristic shown in FIG. 14, the reflection loss S11 is below −10 dB in the vicinity of 2.5 GHz at a bandwidth of approximately 100 MHz, and is below −10 dB in the vicinity of 5.5 GHz at a bandwidth of approximately 800 MHz. Consequently, the multi-frequency antenna 2 can acquire a sufficient gain at the two frequencies: 2.5 GHz; and 5.5 GHz.

As explained above, according to the second embodiment of the present invention, it is possible to provide the multi-frequency antenna 2 which transmits/receives wireless signals at multiple frequency bands by using the single antenna element with low loss.

In addition, such loss can be adjusted by adjusting the central angle θ of the sector.

In the above-explained illustrative configuration, the configuration enabling acquisition of a gain at the two frequency bands: 2.5 GHz; and 5.5 GHz was exemplified. The present embodiment is not limited to this configuration. The present embodiment can cope with a combination of any arbitrary two frequency bands.

That is, the element constant of the equivalent circuit 111 of the antenna element and that of the equivalent circuit 112 coupled with a space are automatically determined based on the size of the antenna element 210 and on the central angle θ thereof. Accordingly, it is possible for the multi-frequency antenna to acquire sufficient gains at arbitrary multiple frequency bands by setting the inductance of the shunt inductor L2 (120), the capacitance of the series capacitor C1 and the inductance of the series inductor L1 (140) accordingly so that the resonance point is generated in respective vicinities of multiple target frequencies in consideration of individual element constants determined by the size of the antenna element 210 and by the central angle θ thereof.

Moreover, when the size of the antenna element 210 and the central angle θ thereof are changeable, it is appropriate if the size of the antenna element 210 and the central angle thereof are set in consideration of a loss and a permitted maximum size, and the inductance of the shunt inductor L2 (120), the capacitance of the series capacitor C1 and the inductance of the series inductor L1 (140) are set accordingly so that the resonance point is generated in the vicinities of the multiple target frequencies in consideration of the individual element constants determined by the size of the antenna element 210.

Furthermore, for example, in the second embodiment, although the antenna element 210 is sectorial, it is appropriate if a width at the open-end side is wide with respect to the feeding-point side, and the antenna element may be triangular, trapezoidal, etc.

The present invention is not limited to the foregoing first and second embodiments, and can be changed and modified in various forms.

For example, the configuration of the multi-frequency antenna of the present invention is not limited to the configurations shown in FIGS. 1 to 4, and in FIGS. 11 and 12.

For example, in the first and second embodiments, although the capacitor conductor 130 and one end of the series inductor 140 are connected together through the via 135, the via 135 may be omitted, and the capacitor conductor 130 and the series inductor 140 may be coupled together through a capacitance therebetween.

Figure 15:
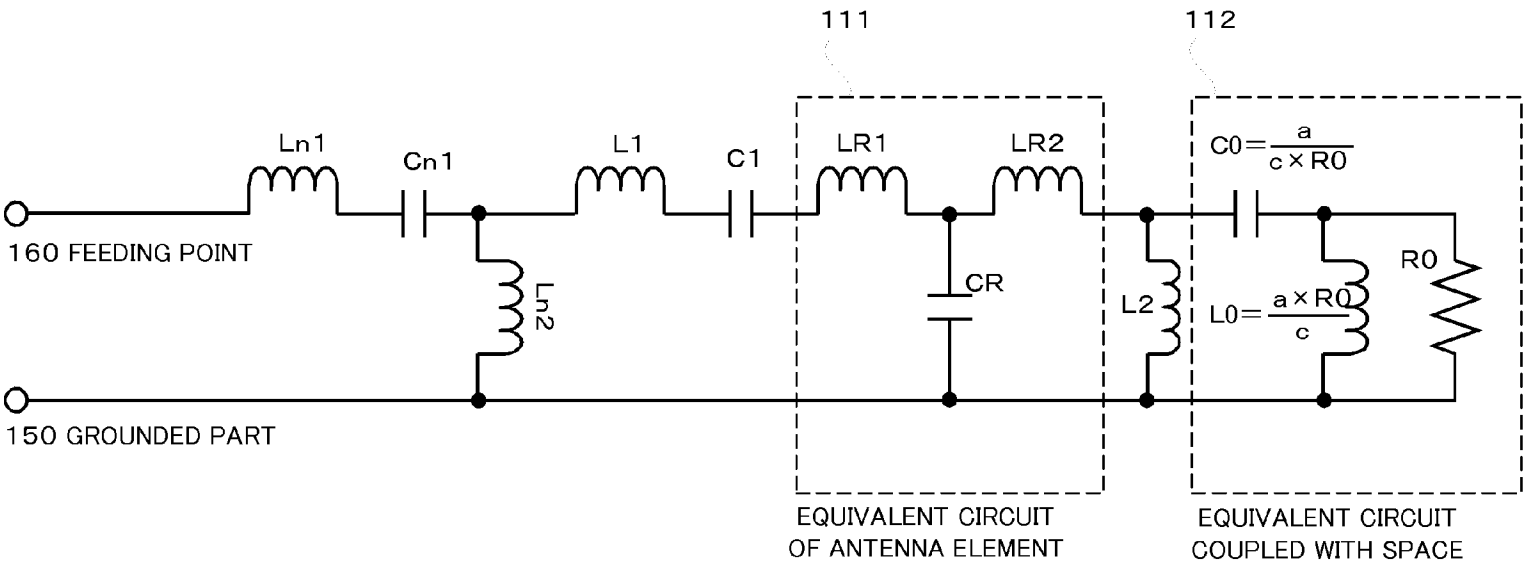
FIG. 15 is a diagram showing an illustrative equivalent circuit of a multi-frequency antenna having a sufficient gain at each of equal to or more than three frequency bands.
Figure 16:
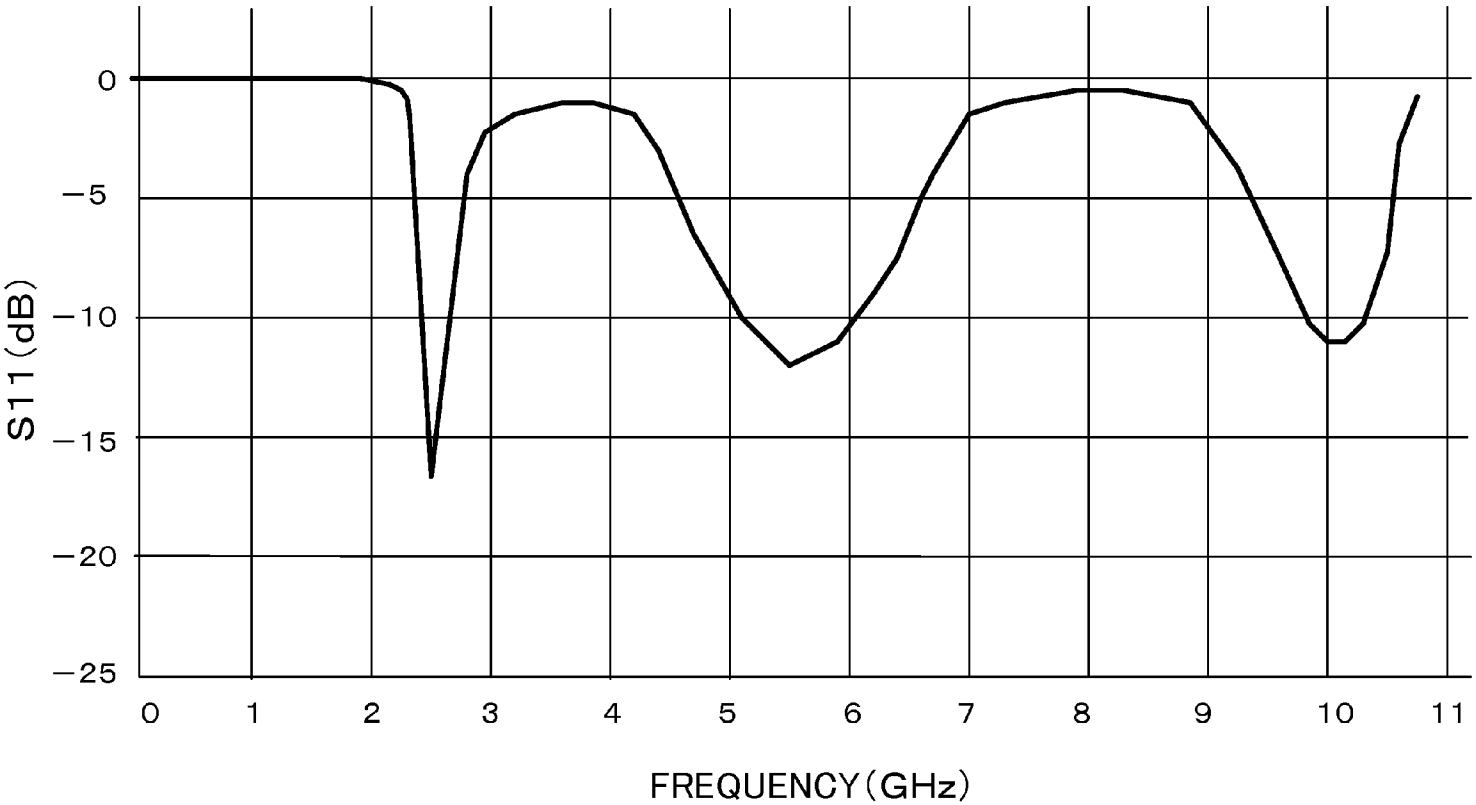
FIG. 16 is a graph showing an illustrative frequency characteristic of reflection loss by the multi-frequency antenna having the sufficient gain at each of equal to or more than three frequency bands.

Moreover, in the foregoing embodiments, although the configurations of the multi-frequency antenna having a resonance point (an operating point) at the two frequency bands were exemplified, the present invention can be applied to a multi-frequency antenna having a resonance point at equal to or more than three frequency bands. For example, as shown in FIG. 15, by adding elements (Cn1, Ln1 and Ln2 in the figure) configuring an arbitrary LC resonant circuit to the original circuit, it is possible to realize a multi-frequency antenna which has equal to or more than three resonance points and has a sufficient gain at equal to or more than three frequency bands as shown in FIG. 16.

Furthermore, in the foregoing embodiments, the inductors, the conductors, etc., are realized by lines (circuit patterns), but some of or all of the inductors and conductors may be realized by, for example, chip components. A circuit may be configured by arranging, for example, as shown in FIG. 17, plural chip components C1, L1, L2, Cn1, Ln1 and Ln2 that are individual circuit elements of the circuit shown in FIG. 15 on a substrate 100 and by connecting those chip components together by low-impedance lines.

Figure 17:
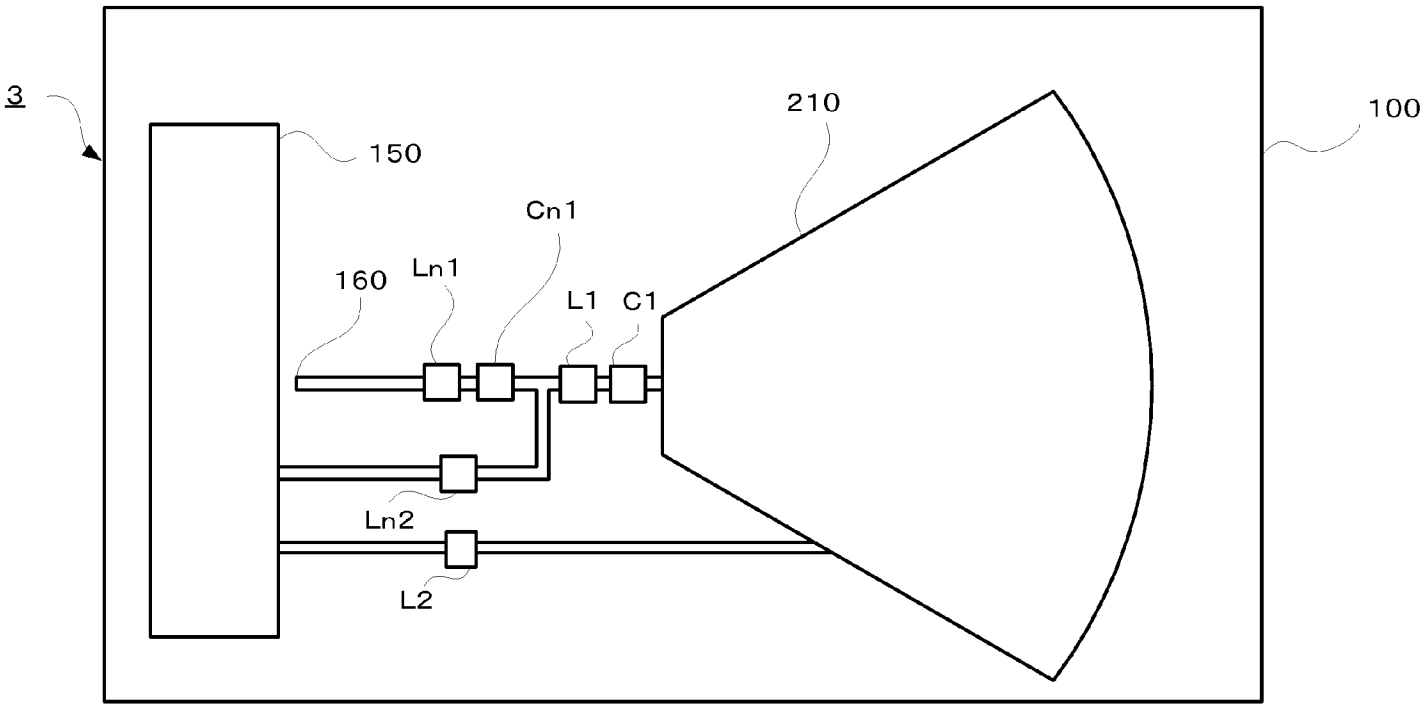
FIG. 17 is a diagram showing an example case in which a circuit element configuring an antenna comprises a chip component.

Moreover, in the first and second embodiments, although the circuit is arranged on the one-side surface of the substrate 100 and on another-side surface thereof, as is exemplified in FIG. 17, the circuit may be arranged on only the one-side surface. The same is true for a case in which the circuit is realized by means of a pattern.

Furthermore, in the foregoing embodiments, although the circuit elements have respective predetermined physical characteristic values (inductances and capacitances), each circuit element may be changed to an active circuit element with a function of adjusting the physical characteristic value, and may be tuned by feeding back a reflected signal from the antenna element.

Figure 18:
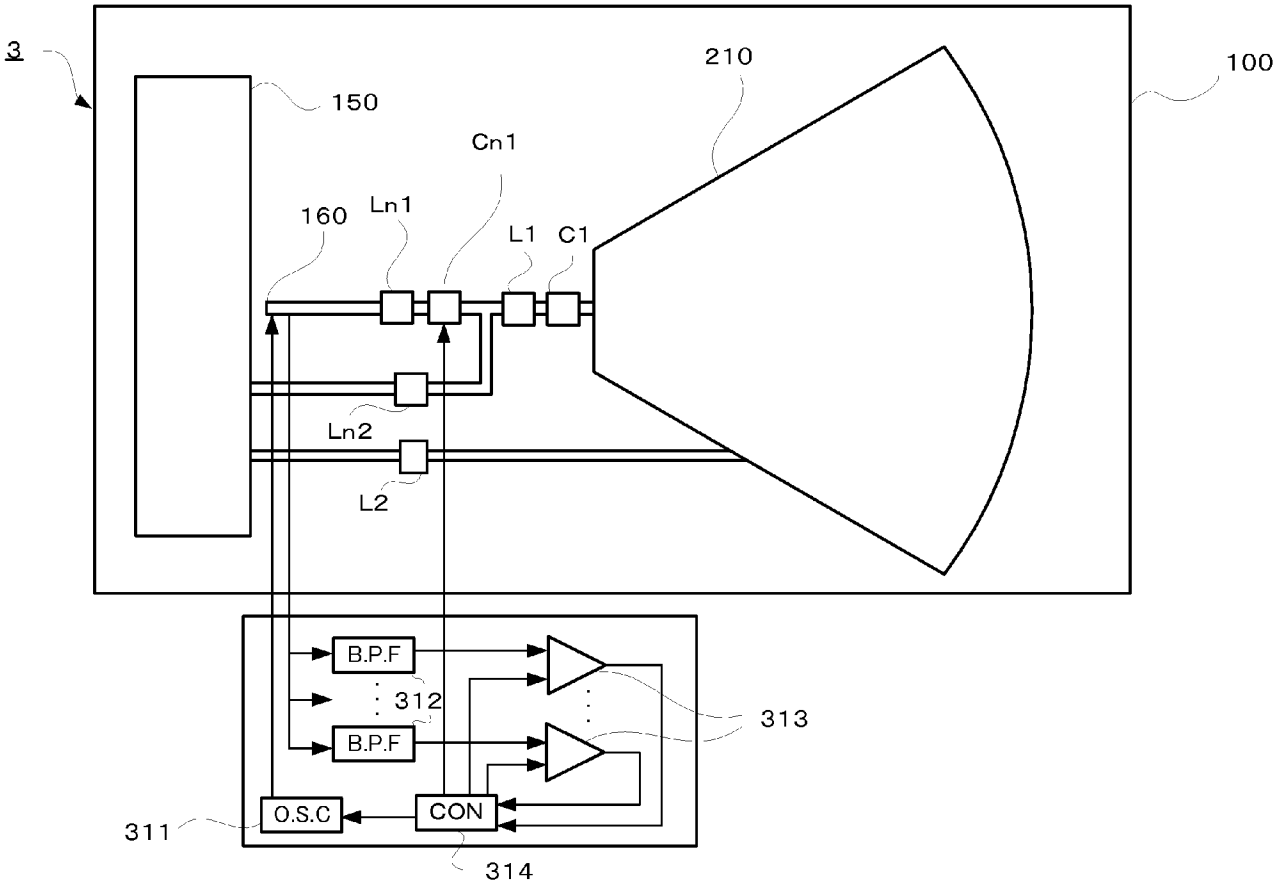
FIG. 18 is a diagram showing an illustrative configuration of a multi-frequency antenna having an automatic-tuning function.

In this case, for example, as shown in FIG. 18, a variable frequency oscillator (O.S.C) 311 connected to a feeding point 160, plural bandpass filters (B.P.F) 312 each having a passband at a target frequency, comparators 313 and a control unit (CON) 314 are added. Moreover, series capacitors C1 and Cn1 each comprises a varicap (a varactor). In this case, the control part 314 controls the variable frequency oscillator 311 so as to scan an oscillation frequency, and determines the level of a reflected wave at this time by causing the comparator 313 to compare a passing signal of the bandpass filter 312 with a reference voltage. When no sufficient characteristic is acquired at a target frequency, a process of adjusting the position of a resonance point is repeated accordingly by controlling, for example, respective capacities of the varicaps C1 and Cn1. Note that inductances of individual inductors may be changed under the control of the control unit 314.

According to this configuration, the antenna can be adjusted so as to automatically have an appropriate gain with respect to a desired frequency.

In the foregoing embodiments, although the configuration with the circuit elements arranged on the substrate comprising a dielectric material was exemplified, no substrate may be arranged as far as the individual circuit elements can be held.

This application is based on Japanese Patent Application No. 2009-180009 filed on Jul. 31, 2009. The specification, claims, and drawings of this Japanese Patent Application No. 2009-180009 are entirely incorporated herein by reference in this specification.

INDUSTRIAL APPLICABILITY

A multi-frequency antenna of the present invention can be used for wireless communication.

DESCRIPTION OF REFERENCE NUMERALS

1, 2 Multi-frequency antenna
100 Substrate
110 Antenna element
115 Via
120 Shunt inductor
130 Capacitor conductor
135 Via
140 Series inductor
150 Grounded part
151, 152 Ground conductor
153 Via
160 Feeding point
210 Antenna element
311 Variable frequency oscillator
312 Bandpass filter
313 Comparator
314 Control part

The invention claimed is:

1. A multi-frequency antenna comprising:

an antenna element;

a first inductor that connects the antenna element and a grounded part together, wherein a first end of the first inductor is connected to the grounded part, and wherein a second end of the first inductor is connected to the antenna element directly or through a via;

a feeding point; and a series circuit which includes a second inductor and a capacitor, and which connects the feeding point and the antenna element together, wherein the first inductor and the series circuit are connected at different parts of the antenna element.

2. The multi-frequency antenna according to claim 1, wherein inductances of the first inductor and the second inductor and a capacitance of the capacitor each has a value generating multiple resonance frequencies.

3. The multi-frequency antenna according to claim 1, wherein a shape of the antenna element is a rectangle.

4. The multi-frequency antenna according to claim 1, further comprising a dielectric plate, wherein the antenna element is formed on one face of the dielectric plate, and the first inductor is arranged on another face of the dielectric plate and is connected to the antenna element at the second end thereof through the via.

5. The multi-frequency antenna according to claim 1, wherein at least one of the first inductor, the second inductor, and the capacitor comprises a chip component.

6. The multi-frequency antenna according to claim 1, wherein at least one of the first inductor and the second inductor comprises a line.

7. The multi-frequency antenna according to claim 1, further comprising an adjuster which adjusts at least one element constant of the first inductor, the second inductor, and the capacitor.

8. The multi-frequency antenna according to claim 4, wherein the first inductor is connected to a substantial center of the antenna element through the via.

9. The multi-frequency antenna according to claim 4, wherein:

the capacitor comprises a part of the antenna element, a conductive body which is arranged on the another face of the dielectric plate and which faces the part of the antenna element, and the dielectric plate arranged between the part of the antenna element and the conductive body, and the second inductor is arranged on the one face of the dielectric plate and is connected between the capacitor and the feeding point.

10. The multi-frequency antenna according to claim 9, wherein the second inductor is connected to the conductive body through a via or by capacitive coupling.

11. The multi-frequency antenna according to claim 1, wherein a shape of the antenna element is a shape with a width at an open-end side which is wider than a width at a feeding-point side.

12. The multi-frequency antenna according to claim 1, wherein the second end of the first inductor is connected to the antenna element directly.

13. A multi-frequency antenna comprising:

an antenna element;

a first inductor that connects the antenna element and a grounded part together;

a feeding point;

a series circuit which includes a second inductor and a capacitor, and which connects the feeding point and the antenna element together, wherein the first inductor and the series circuit are connected at different parts of the antenna element; and a dielectric plate, wherein the antenna element is formed on one face of the dielectric plate, and the first inductor is arranged on another face of the dielectric plate and is connected to the antenna element through a via, wherein the capacitor comprises a part of the antenna element, a conductive body which is arranged on the another face of the dielectric plate and which faces the part of the antenna element, and the dielectric plate arranged between the part of the antenna element and the conductive body, and wherein the second inductor is arranged on the one face of the dielectric plate and is connected between the capacitor and the feeding point.

14. The multi-frequency antenna according to claim 13, wherein the second inductor is connected to the conductive body through a via or by capacitive coupling.

15. The multi-frequency antenna according to claim 13, wherein inductances of the first inductor and the second inductor and a capacitance of the capacitor each has a value generating multiple resonance frequencies.

16. The multi-frequency antenna according to claim 13, wherein a shape of the antenna element is a rectangle.

17. The multi-frequency antenna according to claim 13, wherein at least one of the first inductor, the second inductor, and the capacitor comprises a chip component.

18. The multi-frequency antenna according to claim 13, wherein at least one of the first inductor and the second inductor comprises a line.

19. The multi-frequency antenna according to claim 13, wherein the first inductor is connected to a substantial center of the antenna element through the via.

20. The multi-frequency antenna according to claim 13, wherein a shape of the antenna element is a shape with a width at an open-end side which is wider than a width at a feeding-point side.

* * * * *